US012576951B2

(12) United States Patent
Kuchiki et al.

(10) Patent No.: US 12,576,951 B2
(45) Date of Patent: Mar. 17, 2026

(54) SAFETY SYSTEM, LAND SYSTEM, ON-SHIP SYSTEM, AND CONTROL METHOD

(71) Applicant: MITSUBISHI SHIPBUILDING CO., LTD., Yokohama (JP)

(72) Inventors: Yusuke Kuchiki, Yokohama (JP); Shingen Takeda, Yokohama (JP); Toshiyuki Komiya, Yokohama (JP)

(73) Assignee: MITSUBISHI SHIPBUILDING CO., LTD., Yokohama (JP)

( * ) Notice: Subject to any disclaimer, the term of this patent is extended or adjusted under 35 U.S.C. 154(b) by 129 days.

(21) Appl. No.: 18/293,970

(22) PCT Filed: Apr. 21, 2022

(86) PCT No.: PCT/JP2022/018460
§ 371 (c)(1),
(2) Date: Jan. 31, 2024

(87) PCT Pub. No.: WO2023/032349
PCT Pub. Date: Mar. 9, 2023

(65) Prior Publication Data

US 2025/0074556 A1 Mar. 6, 2025

(30) Foreign Application Priority Data

Aug. 31, 2021 (JP) ..... 2021-140870

(51) Int. Cl.
*B63B 43/00* (2006.01)
*B63B 81/00* (2020.01)

(52) U.S. Cl.
CPC ..... *B63B 43/00* (2013.01); *B63B 81/00* (2020.01)

(58) Field of Classification Search
CPC ... B63B 43/00; B63B 81/00; B63B 2043/006; H04M 11/04; A62C 3/10
(Continued)

(56) References Cited

U.S. PATENT DOCUMENTS 6,927,669 B2 * 8/2005 Tanaka ..... B60R 25/00 340/545.9
7,667,613 B2 * 2/2010 Stevens ..... G09F 19/22 340/8.1
(Continued)

FOREIGN PATENT DOCUMENTS

CN 107464395 A 12/2017
CN 209972734 U 1/2020
(Continued)

OTHER PUBLICATIONS

PCT/ISA/210, "International Search Report for PCT International Application No. PCT/JP2022/018460," Jul. 5, 2022.
(Continued)

*Primary Examiner* — Krishnan Ramesh
(74) *Attorney, Agent, or Firm* — HAUPTMAN HAM, LLP

(57) ABSTRACT

A safety system according to the present invention includes an on-ship system which is provided on a ship and a land system which is provided on land. The on-ship system and the land system each obtain, from a safety detection device and a safety maintenance device which are provided on a ship, data which has been detected by the safety detection device and a signal which indicates a state of the safety maintenance device, and, on the basis of the obtained data and signal, transmit to the safety maintenance device a control signal for controlling the safety maintenance device.

7 Claims, 6 Drawing Sheets

(58) Field of Classification Search
USPC ..... 701/21
See application file for complete search history.

(56) References Cited

U.S. PATENT DOCUMENTS

| | | | | |
|---|---|---|---|---|
| 11,195,419 | B2 * | 12/2021 | Suzuki | G08G 3/02 |
| 2008/0282817 | A1 * | 11/2008 | Breed | B60R 21/01516 73/865.9 |
| 2016/0121989 | A1 * | 5/2016 | Okuda | G05D 1/0011 701/2 |
| 2017/0158303 | A1 * | 6/2017 | Michaelis | G06V 10/75 |
| 2017/0284808 | A1 * | 10/2017 | Saito | B63B 49/00 |
| 2018/0200552 | A1 * | 7/2018 | Wertsberger | A62C 37/40 |
| 2021/0358309 | A1 * | 11/2021 | Watanabe | G08G 3/02 |
| 2021/0366291 | A1 * | 11/2021 | Watanabe | G08G 3/02 |
| 2022/0241634 | A1 * | 8/2022 | Krutskevych | G08B 25/04 |

FOREIGN PATENT DOCUMENTS

| | | | |
|---|---|---|---|
| JP | 2009-282963 | A | 12/2009 |
| JP | 2020-194219 | A | 12/2020 |
| KR | 1020160014422 | A | 2/2016 |
| KR | 101641787 | B1 | 7/2016 |
| KR | 10-2016-0134095 | A | 11/2016 |
| KR | 10-2018-0130950 | A | 12/2018 |

OTHER PUBLICATIONS

PCT/ISA/237, "Written Opinion for PCT International Application No. PCT/JP2022/018460," Jul. 5, 2022.

* cited by examiner

FIG. 2

EXAMPLE OF SAFETY DEVICES

| NUMBER | DEVICE NAME | PURPOSE | MONITORING | CONTROL |
|---|---|---|---|---|
| 1 | POWER TYPE VENTILATION DEVICE | FIRE SPREAD PREVENTION | O | O |
| 2 | FIRE PREVENTION DOOR | FIRE SPREAD PREVENTION | O | O |
| 3 | GENERAL EMERGENCY ALARM DEVICE | PASSENGER-CREW MEMBER CONTROL | O | O |
| 4 | ON-SHIP NOTIFICATION DEVICE | PASSENGER-CREW MEMBER CONTROL | O | O |
| 5 | ELECTRIC DRIVE TYPE EVACUATION GUIDANCE DEVICE | EVACUATION GUIDE AND PASSENGER-CREW MEMBER CONTROL | O | O |
| 6 | WATERTIGHT DOOR AND SEMI-WATERTIGHT DOOR | FLOOD SPREAD PREVENTION | O | O |
| 7 | INDICATOR FOR CLOSING DEVICE SUCH AS GANGWAY DOOR OR CARGO GATE DOOR | OPENING/CLOSING STATE MONITORING | O | - |
| 8 | LEAKAGE FROM SIDE SKIN DOORS OF SHIP | LEAKAGE STATE MONITORING | O | - |
| 9 | TELEVISION MONITORING DEVICE | ON-SHIP MONITORING | O | - |
| 10 | FIRE DETECTION ALARM DEVICE | FIRE PRESENCE/ABSENCE MONITORING | O | - |
| 11 | FIXED LOCAL FIRE EXTINGUISHING DEVICE | FIRE EXTINGUISHING | O | O |
| 12 | SPRINKLER | FIRE EXTINGUISHING | O | O |
| 13 | WATER-BASED FIRE EXTINGUISHING DEVICE FOR MACHINERY AREA | FIRE EXTINGUISHING | O | O |
| 14 | CREW MEMBER CALL ALARM | CREW MEMBER CONTROL | O | O |
| 15 | SMOKE EVACUATION DEVICE | SMOKE EVACUATION | O | O |
| 16 | FLOOD DETECTION DEVICE | FLOOD PRESENCE/ABSENCE MONITORING | O | - |
| 17 | FIRE PUMP AND EMERGENCY FIRE EXTINGUISHING PUMP | FIRE EXTINGUISHING | O | O |
| 18 | HULL POSTURE DRAFT GAUGE | HALL POSTURE MONITORING | O | - |
| 19 | ISOLATION VALVE | FLOOD SPREAD PREVENTION | O | O |
| 20 | DRAIN PUMP | DRAINAGE | O | O |

FIG. 4

| PRIORITY | OPERATION MODE 1 (NORMAL: ON-SHIP/PRIORITY) | OPERATION MODE 2 (LAND/PRIORITY) | OPERATION MODE 3 (LAND/INVALID) | OPERATION MODE 4 (ON-SHIP/INVALID) |
|---|---|---|---|---|
| 1 | MANUAL | MANUAL | MANUAL | MANUAL |
| 2 | ON-SHIP MONITORING SYSTEM | LAND SYSTEM | ON-SHIP MONITORING SYSTEM | LAND SYSTEM |
| 3 | AUTOMATIC | AUTOMATIC | AUTOMATIC | AUTOMATIC |
| 4 | LAND SYSTEM | ON-SHIP MONITORING SYSTEM | LAND SYSTEM (ONLY MONITORING) | ON-SHIP MONITORING SYSTEM (ONLY MONITORING) |

SAFETY SYSTEM, LAND SYSTEM, ON-SHIP SYSTEM, AND CONTROL METHOD

TECHNICAL FIELD

The present disclosure relates to a safety system, a land system, an on-ship system, and a control method.

The present application claims priority based on Japanese Patent Application No. 2021-140870 filed in Japan on Aug. 31, 2021, the content of which is incorporated herein by reference.

BACKGROUND ART

When a disaster such as fire or flooding occurs on a ship, a crew member appropriately controls a safety device installed on the ship to respond to the disaster. For example, PTL 1 discloses a flood notification system that notifies crew members of information for appropriately performing initial response and evacuation to flooding when flooding occurs on a ship. When a disaster occurs, there is a possibility that there will be a shortage of crew members due to the need to respond to the disaster and guide passengers to evacuate. Depending on a situation on the ship, actions of the crew members may be restricted and sufficient disaster response may not be possible.

CITATION LIST

Patent Literature

[PTL 1] Japanese Unexamined Patent Application Publication No. 2020-194219

SUMMARY OF INVENTION

Technical Problem

There is a concern that a disaster response may be inadequate when only crew members on a ship respond to the disaster.

The present disclosure provides a safety system, a land system, an on-ship system, and a control method capable of solving the above problems.

Solution to Problem

According to an aspect of the present disclosure, a safety system includes: an on-ship system that is provided on a ship; and a land system that is provided on land, in which the on-ship system includes a safety detection device and a safety maintenance device that are provided on the ship, a first acquisition unit that acquires information detected by the safety detection device and information indicating a state of the safety maintenance device, a first control unit that controls the safety maintenance device, and a communication unit that communicates with the land system, and the land system includes a second acquisition unit that acquires the information detected by the safety detection device and the information indicating the state of the safety maintenance device through the communication unit, and a second control unit that outputs a control signal for controlling the safety maintenance device to the safety maintenance device through the communication unit.

According to another aspect of the present disclosure, a land system includes: a communication unit that communicates with a safety detection device and a safety maintenance device, which are provided on a ship, through a communication device provided on the ship; an acquisition unit that acquires information detected by the safety detection device and information indicating a state of the safety maintenance device through the communication unit; and a control unit that outputs a control signal for controlling the safety maintenance device to the safety maintenance device through the communication unit.

According to still another aspect of the present disclosure, an on-ship system includes: a safety detection device and a safety maintenance device that are provided on a ship; an acquisition unit that acquires information detected by the safety detection device and information indicating a state of the safety maintenance device; a control unit that controls the safety maintenance device; and a communication unit that transmits the information detected by the safety detection device and the information indicating the state of the safety maintenance device to a land system and receives a control signal for controlling the safety maintenance device from the land system.

According to still another aspect of the present disclosure, a control method of a safety maintenance device provided on a ship, the control method includes: a step of acquiring, by an on-ship system provided on the ship, information detected by a safety detection device provided on the ship and information indicating a state of the safety maintenance device; a step of transmitting, by the on-ship system, the information acquired in the step of acquiring to a land system provided on land; a step of acquiring, by the land system, the information transmitted in the step of transmitting; and a step of transmitting, by the land system, a control signal for controlling the safety maintenance device to the safety maintenance device.

Advantageous Effects of Invention

According to the safety system, the land system, the on-ship system, and the control method described above, monitoring related to ship safety and control of a safety device, which can generally only be performed on a ship, can be performed on land as well as on a ship.

BRIEF DESCRIPTION OF DRAWINGS

FIG. 2 is a diagram showing an example of safety devices according to the embodiment.

FIG. 4 is a diagram showing an example of priorities in controls of the safety system according to the embodiment.

DESCRIPTION OF EMBODIMENTS

Embodiment

Hereinafter, a safety system of the present disclosure will be described with reference to FIGS. 1 to 5.

(System Configuration)

Figure 1:
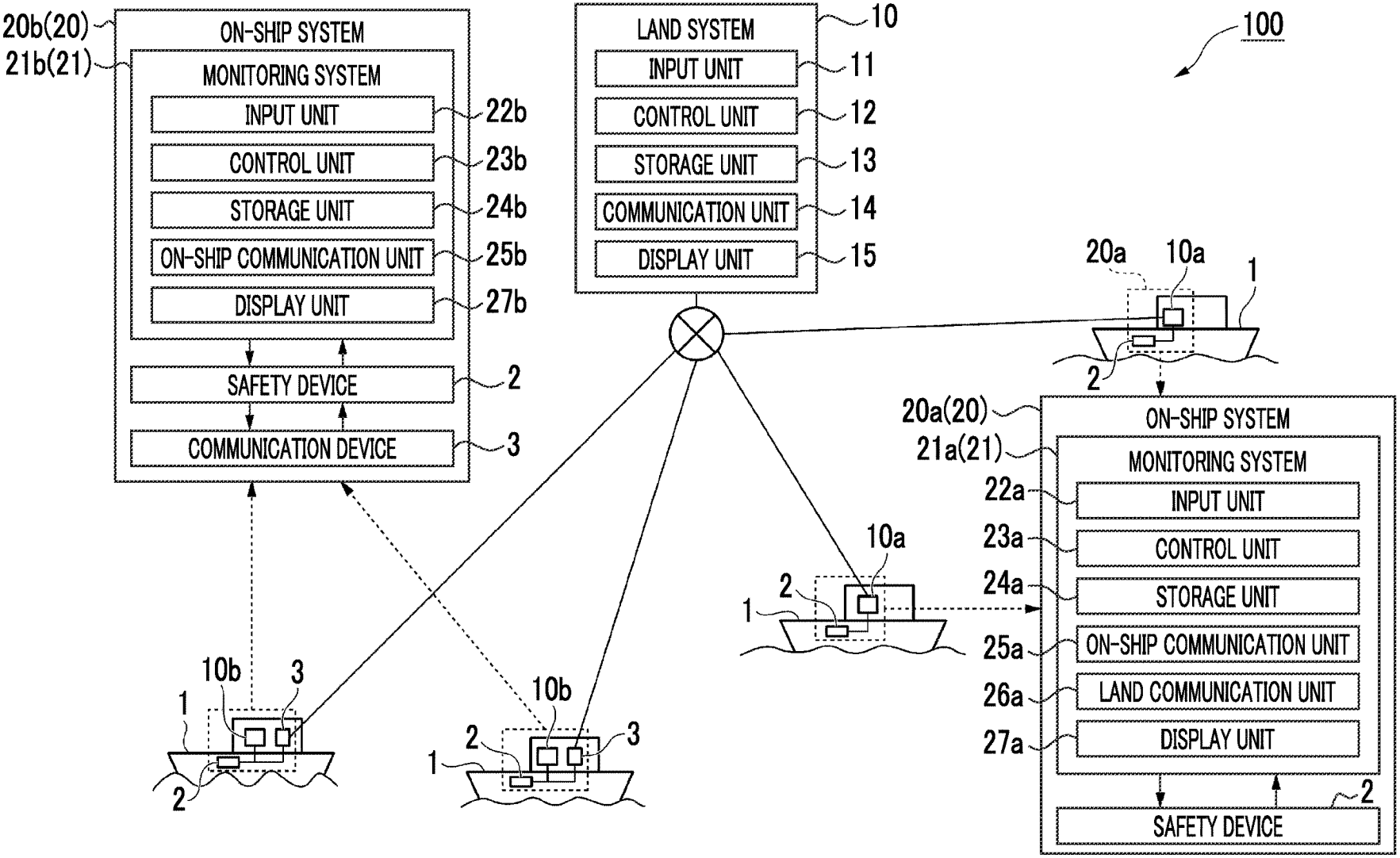
FIG. 1 is a diagram showing an example of a safety system according to an embodiment.

FIG. 1 is a diagram showing an example of a safety system according to an embodiment.

The safety system 100 includes an on-ship system 20 mounted on each of one or a plurality of ships 1 and a land system 10 provided in a monitoring station on land. The land system 10 and the on-ship system 20 of each ship 1 are connected to each other via a network in a communicable manner. The on-ship system 20 is a system that monitors and controls a safety device in the ship 1. In general, the ship 1 is provided with the on-ship system 20 for monitoring the safety on the ship or responding to a disaster. The on-ship system 20 constantly monitors the ship, and when a disaster such as fire or flooding occurs, the on-ship system 20 responds to the disaster by operating the safety device 2. On the other hand, in the safety system 100 of the present embodiment, in addition to the on-ship system 20, the land system 10 having the same function and configuration as the on-ship system 20 is provided on land, and remote monitoring of a plurality of ships 1 is also performed from the land system 10. When a disaster occurs on the ship 1, the safety device 2 included in the ship 1 is remotely controlled to respond to the disaster.

The on-ship system 20 is classified into an on-ship system 20*a*, which includes a safety device 2 and a monitoring system 21*a* monitoring and controlling the safety device 2, and an on-ship system 20*b*, which includes a safety device 2, a communication device 3, and a monitoring system 21*b*. In the on-ship system 20*a*, the monitoring system 21*a* communicates with the land system 10, and the land system 10 monitors and controls the safety device 2 through the monitoring system 21*a*. In the on-ship system 20*b*, the communication device 3 communicates with the land system 10, and the land system 10 monitors and controls the safety device 2 through the communication device 3 without going through the monitoring system 21*b*. When no particular distinction is required, the on-ship systems 20*a* and 20*b* may be referred to as the on-ship system 20 and the monitoring systems 21*a* and 21*b* may be referred to as the monitoring system 21.

(Safety Device)

The safety device 2 includes sensors for detecting a safety situation on the ship or facility for maintaining the safety on the ship. An example of the safety devices 2 is shown in FIG. 2. A power type ventilation device of an item number 1 is equipment for fire spread prevention. For example, in the event of fire, control is performed such that oxygen is stopped so as not to be supplied to a place where the fire has occurred. The monitoring system 21 can monitor an operation state (whether it is being activated or stopped) of the power type ventilation device and can control (activation, stop) the operation of the power type ventilation device. A fire prevention door of an item number 2 is also a device for preventing the spread of the fire, and the monitoring system 21 can monitor the state of the fire prevention door and control the opening and closing of the fire prevention door. A general emergency alarm device and an on-ship notification device of item numbers 3 and 4 are notification devices for controlling passengers and crew members. The monitoring system 21 can monitor and control statuses of these devices. Regarding the devices with item numbers 5, 6, 11 to 15, 17, and 19 to 20, the monitoring system 21 can monitor and control the status of each device. For example, in the case of a watertight door and a semi-watertight door of an item number 6, the spread of flooding can be prevented by closing the watertight door, and in the case of a sprinkler of an item number 12, the fire can be extinguished by operating the sprinkler. Devices of item numbers 7 to 10, 16, and 18 are sensors for detecting a disaster situation on the ship and a state of a hull (for example, a posture of the hull) related to the disaster. The monitoring system 21 can acquire and monitor information detected by each device (sensor). For example, in the case of a fire detection alarm device of an item number 10, the location of the fire can be determined based on a position of the fire detection alarm device, in which the fire is detected, installed in the ship. Similarly, in the case of a flood detection device of an item number 16, the flood occurrence location can be determined based on a position of the flood detection device, in which the flooding is detected, installed in the ship.

The safety devices illustrated in FIG. 2 is an example. For example, it is required to provide a safety center on a ship in safety of life at sea (SOLAS), and in the safety center, it is required that functions (operation, control, monitoring, or a combination thereof) of the safety devices listed below, which are also illustrated in FIG. 2, can be used. That is, the devices are: 1. power type ventilation device, 2. fire prevention door, 3. general emergency alarm device, 4. on-ship notification device, 5. electric drive type evacuation guidance device, 6. watertight door and semi-watertight door, 7. indicator for closing device such as gangway door or cargo gate door, 8. leakage from inner bow door, outer bow door, stern door, or any other side skin doors of ship, 9. television monitoring device, 10. fire detection alarm device, 11. fixed local fire extinguishing device, 12. sprinkler and equivalent device, 13. water-based fire extinguishing device for machinery area, 14. crew member call alarm, 15. atrium smoke evacuation device, 16. flood detection device, 17. fire pump and emergency fire extinguishing pump. A monitor or a control panel that monitors these safety devices are installed in the safety center. As for the ship 1 to which the SOLAS is not applied, generally, a control room is provided with various safety devices 2 defined with regulations and a control system for controlling these safety devices 2. The on-ship system 20 of the present embodiment corresponds to a control room provided with a safety center and a safety device defined in the SOLAS, and a safety device and a control system in a ship to which SOLAS is not applied.

When a disaster such as fire or flooding occurs, the fire detection alarm device (item number 10 in FIG. 2) or the flood detection device (item number 16 in FIG. 2) are operated, and the crew member recognizes the occurrence of fire or the like. The crew member operates the control panel of the safety center or the control system to notify other crew members of an alarm (item number 14 in FIG. 2), and control the appropriate safety device 2 to perform response to prevent the spread of fire and flooding. When the functions of the safety center or the control system are maintained in the event of a disaster and the situation on the ship does not affect the operation of the crew member, the on-ship system 20 can respond to the disaster. However, when a situation occurs in which the crew member cannot make a calm judgment and take measures at the safety center due to the fire or flooding (for example, a flame or smoke is approaching, a large inclination is caused by the flooding, or the like), the disaster response using the on-ship system 20 is not possible. In recent years, there has been a tendency to require labor savings for the crew members on the ship 1, and in the labor-saving ship 1, there is a possibility that there will be a shortage of crew members available for disaster response. Therefore, in the present embodiment, by constructing the land system 10 on the land side that has the same functions and configuration as the on-ship system 20, the safety device 2 of the ship 1 can be monitored and controlled regardless of the situation on the ship or the shortage of crew members.

(Configuration of On-ship System 20*a*)

The on-ship system 20*a* includes the monitoring system 21*a* and the safety device 2. The monitoring system 21*a* is configured with a computer and includes an input unit 22*a*, a control unit 23*a*, a storage unit 24*a*, an on-ship communication unit 25*a*, a land communication unit 26*a*, and a display unit 27*a*.

The input unit 22*a* is configured by using an input device such as a keyboard, a mouse, a touch panel, and a button. The input unit 22*a* receives a user's input to the monitoring system 21*a*. The input unit 22*a* outputs the content of the received input to the control unit 23*a*.

The control unit 23*a* performs control of the safety device 2, display control of the display unit 27*a*, communication control with the safety device 2 via the on-ship communication unit 25*a*, communication control with the land system 10 via the land communication unit 26*a*, and the like. For example, the control unit 23*a* acquires information (for example, the occurrence of fire and the location of fire) detected by the safety device 2 (sensors exemplified in item numbers 7 to 10, 16, and 18 in FIG. 2) and an operation state (activation/stop, opening/closing, or the like) of the safety device 2 (control target device exemplified in item number 1 in FIG. 2) through the land communication unit 26*a*, and displays the information on the display unit 27*a*. The control unit 23*a* generates a control signal (for example, issuing a crew member call alarm, stopping the power type ventilation device, or the like) to the safety device 2 based on the operation of the crew member and outputs the generated control signal to the safety device 2 to be controlled through the land communication unit 26*a*.

The storage unit 24*a* is configured by using a storage device such as an HDD or a flash memory and stores the information or the like acquired from the safety device 2.

The on-ship communication unit 25*a* communicates with the safety device 2. For example, the on-ship communication unit 25*a* receives, from the safety device 2, information indicating a situation on the ship and an operation state of the safety device 2 in real time. The on-ship communication unit 25*a* transmits the control signal to the safety device 2.

The land communication unit 26*a* communicates with the land system 10. For example, the land communication unit 26*a* receives, from the safety device 2, the information indicating the situation on the ship or the operation state of the safety device 2 through the on-ship communication unit 25*a* in real time and transmits the information to the land system 10. The land communication unit 26*a* receives the control signal transmitted by the land system 10 to the safety device 2 and transmits the control signal to the safety device 2 through the on-ship communication unit 25*a*.

The display unit 27*a* is configured by using a display device such as a liquid crystal display. The display unit 27*a* displays any information based on an instruction of the control unit 23*a*. For example, the display unit 27*a* displays the information received from the safety device 2 (the information detected by the sensors, the operation state of the safety device 2, or the like).

The safety device 2 is a device (sensor) for detecting information related to the safety of a ship as illustrated in FIG. 2 or a device for maintaining safety. For example, when the safety device 2 is a sensor or a detection device, the safety device 2 includes a sensor body and a communication device. When the safety device 2 is a safety maintenance device such as a power type ventilation device or a crew member call alarm, the safety device 2 includes an actuator, a control device of an actuator, and a communication device.

(Configuration of On-ship System 20*b*)

The on-ship system 20*b* includes the monitoring system 21*b*, the safety device 2, and the communication device 3. The monitoring system 21*b* is configured with a computer and includes an input unit 22*b*, a control unit 23*b*, a storage unit 24*b*, an on-ship communication unit 25*b*, and a display unit 27*b*. The configurations and functions of these functional units are the same as those of the input unit 22*a*, the control unit 23*a*, the storage unit 24*a*, the on-ship communication unit 25*a*, and the display unit 27*a* described above, respectively. The difference from the on-ship system 20*a* is that in the on-ship system 20*a*, the monitoring system 21*a* relays communication between the safety device 2 and the land system 10, whereas in the on-ship system 20*b*, the monitoring system 21*b* does not relay communication with the land system 10. In the on-ship system 20*b*, the communication device 3 relays the communication between the safety device 2 and the land system 10. For example, the communication device 3 receives, from the safety device 2, the information indicating the situation on the ship or the operation state of the safety device 2 in real time and transmits the information to the land system 10. The communication device 3 receives the control signal transmitted by the land system 10 to the safety device 2 and transmits the control signal to the safety device 2. That is, in the case of the on-ship system 20*b*, even when the monitoring system 21*b* malfunctions or the like, the land system 10 can monitor and control the safety device 2 of the ship 1.

(Configuration of Land System 10)

The land system 10 is configured with a computer and includes an input unit 11, a control unit 12, a storage unit 13, a communication unit 14, and a display unit 15.

The input unit 11 is configured by using an input device such as a keyboard, a mouse, a touch panel, and a button. The input unit 11 receives a user's input to the land system 10. The input unit 11 outputs the content of the received input to the control unit 12.

The control unit 12 controls various processes executed by the land system 10. For example, the control unit 12 performs display control of the display unit 15, communication control via the communication unit 14, and the like.

The storage unit 13 is configured by using a storage device such as an HDD or a flash memory and stores the information or the like transmitted from the safety device 2.

The communication unit 14 communicates with the on-ship system 20. For example, the communication unit 14 acquires, from the on-ship system 20, the information indicating the situation on the ship detected by the safety device 2 or the operation state of the safety device 2 in real time. The communication unit 14 transmits the control signal for the safety device 2 to the on-ship system 20.

The display unit 15 is configured by using a display device such as a liquid crystal display. The display unit 15 can display any information based on an instruction of the control unit 12. For example, the display unit 15 displays the situation on the ship (presence or absence of fire or flooding, a video of a television monitoring device, or the like) received from the on-ship system 20.

The land system 10 is constructed by mirroring the safety center or the control room on the ship and has the same functions and configurations as the safety center on the ship and the like. The land system 10 is, so to speak, a safety center or a control room constructed on the land side. There is a monitoring person on land, and the monitoring person monitors a plurality of ships 1. For example, when a disaster or the like occurs in any of the ships 1, the monitoring person monitors data displayed on the display unit 15 and controls the safety device 2 to prevent the spread of the disaster. The input unit 11 receives an input of instruction information for controlling the safety device 2 by the monitoring person, and the control unit 12 transmits the instruction information, which is input to the on-ship system 20, via the communication unit 14.

(Operation)

Next, the operation of the safety system 100 will be described with reference to FIGS. 3A and 3B. As an example, it is assumed that the ship 1 is provided with the safety center, and the crew members monitor the ship at the safety center.

(In Case of On-ship System 20*a*)

Figure 3A:
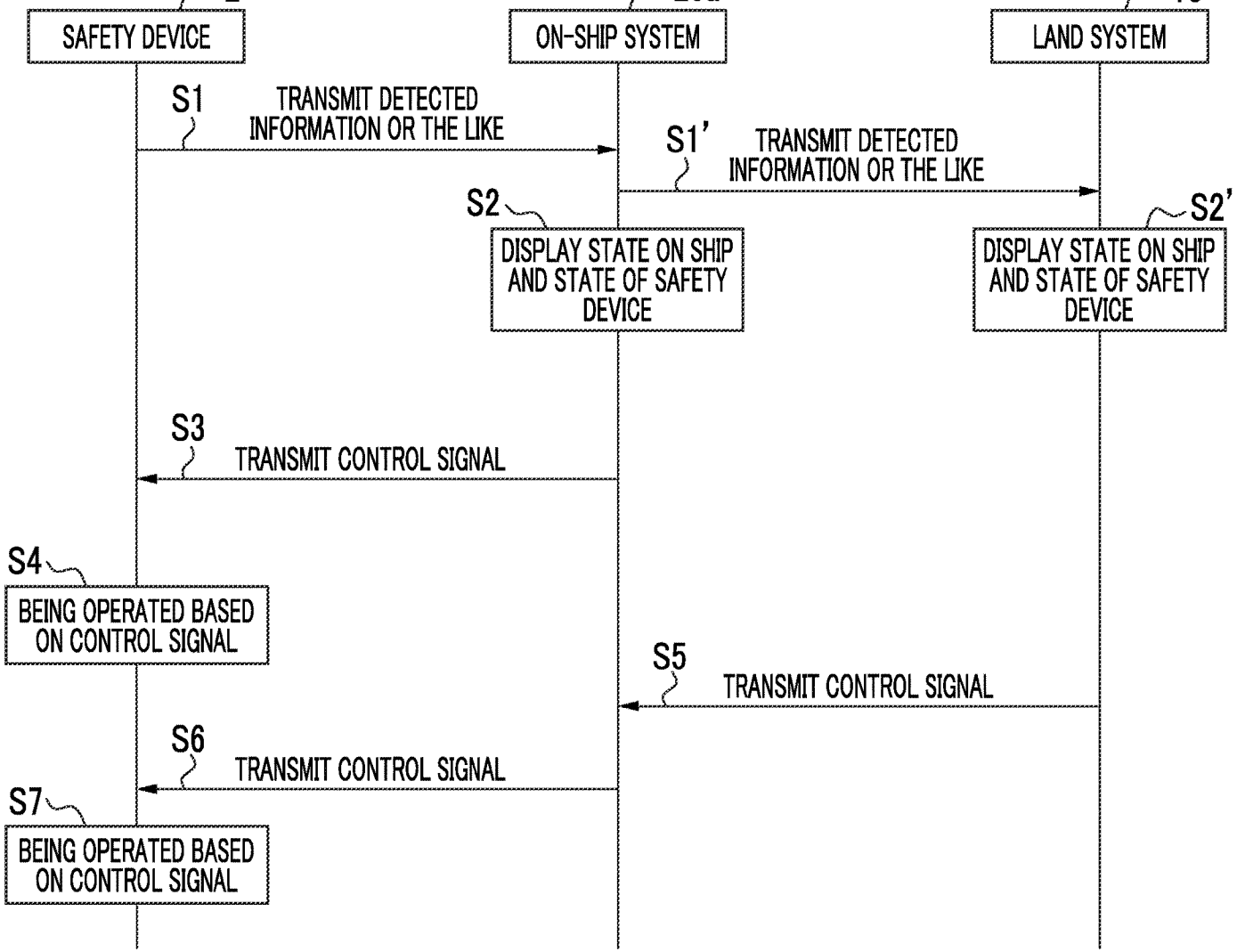
FIG. 3A is a first diagram showing an example of an operation of the safety system according to the embodiment.
Figure 3B:
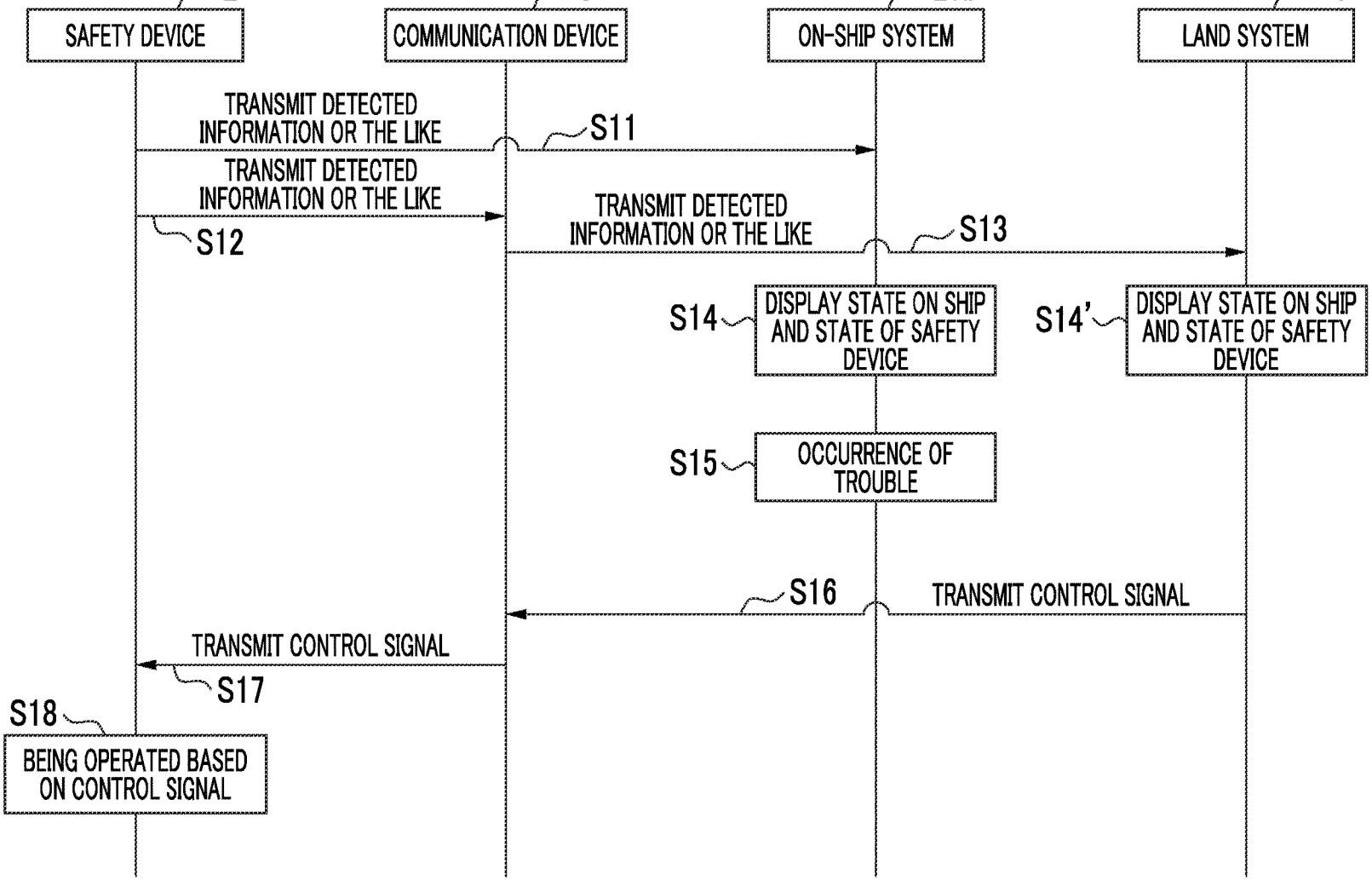
FIG. 3B is a second diagram showing an example of an operation of the safety system according to the embodiment.

FIG. 3A shows an example of an operation of monitoring and control for the safety device 2 of the ship 1 provided with the on-ship system 20*a*. As an example, it is shown an example of the operation in which when a disaster occurs on the ship, the on-ship system 20*a* and the land system 10 cooperate (for example, some of the safety devices 2 are controlled in the on-ship system 20*a*, and other safety devices 2 are controlled from the land system 10) to respond to the disaster. First, each of the plurality of safety devices 2 transmits the information related to the disaster (presence or absence of fire, presence or absence of flooding, inclination of the ship, or the like) detected by the safety device and the information related to the operation state (in operation, stopped, or the like) of the safety device to the on-ship system 20*a* (step S1). In the on-ship system 20*a*, the on-ship communication unit 25*a* acquires the information or the like detected by the safety device 2. The on-ship communication unit 25*a* outputs the acquired information to the control unit 23*a* and the land communication unit 26*a*. The land communication unit 26*a* acquires the information transmitted from the safety device 2 through the on-ship communication unit 25*a* and transmits the information to the land system 10 (step S1').

The control unit 23*a* of the on-ship system 20*a* outputs the information transmitted from the safety device 2 to the display unit 27*a*. For example, the display unit 27*a* displays the information indicating safety on the ship and the information indicating the operation state of each safety device (step S2). The crew member determines whether or not it is necessary to respond to the disaster while monitoring the information displayed on the display unit 27*a*. When a disaster occurs, the crew member operates the control panel at a safety center or the like to control the safety device 2.

In the land system 10, the control unit 12 acquires the information transmitted by the land communication unit 26*a* through the communication unit 14 and outputs the acquired information to the display unit 15. The display unit 15 displays the information indicating safety on the ship and the information indicating the operation state of each safety device (step S2'). The monitoring person on land determines whether or not it is necessary to respond to the disaster while monitoring the information displayed on the display unit 15. When a disaster occurs, the monitoring person operates the land system 10 to remotely control the safety device 2.

When a disaster occurs on the ship, information indicating the occurrence of the disaster is transmitted to the monitoring system 21*a* and the land system 10 by the above process. In the present example, it is assumed that a disaster has occurred. In this case, the crew member determines that it is necessary to respond to the disaster, selects the necessary safety device 2, operates the control panel of the safety center, and performs an operation on the selected safety device 2. The input unit 22*a* receives an input of an instruction operation by the crew member, and the control unit 23*a* generates a control signal to be sent to the safety device 2, which is a control target, based on the instruction operation. Thereafter, the control unit 23*a* transmits the control signal to the safety device 2 through the on-ship communication unit 25*a* (step S3).

The safety device 2, in which the control signal is received from the on-ship system 20*a*, is operated based on the control signal (step S4). For example, when a control signal is issued to close a fire prevention door in the event of fire, the control device for the fire prevention door (safety device 2) controls the actuator in response to the transmitted control signal and performs an operation to close the fire prevention door.

On the other hand, in the monitoring station on land, when the monitoring person determines that the response to the disaster is necessary, the operation on the safety device 2 that needs to be controlled is input to the land system 10. For example, even in a case where predetermined time has elapsed since information indicating the occurrence of the disaster was displayed on the display unit 15, when a control signal for operating the safety device 2 to be controlled (for example, a sprinkler) is not issued from the on-ship system 20*a* (in other words, when the operation state of the safety device to be controlled is not changed to an appropriate state), the monitoring person on land determines that a response is necessary and inputs an instruction operation to be sent to the safety device 2 to the land system 10. Alternatively, in order to speed up the initial response by simultaneously responding on the ship and on land, the on-ship system 20*a* and the land system 10 may be assigned responsibility for the safety devices 2 in advance, and an instruction operation to be sent to the safety device 2 may be input to the land system 10 in accordance with the assigned responsibility. When the instruction operation is input, the input unit 11 receives the input of the instruction operation by the monitoring person, and the control unit 12 generates a control signal to be sent to the safety device 2 based on the instruction operation. Thereafter, the control unit 12 transmits the control signal to the on-ship system 20*a* through the communication unit 14 (step S5). When a control signal is transmitted from the land system 10, the land communication unit 26*a* receives the control signal and transmits the control signal to the safety device 2 through the on-ship communication unit 25*a* (step S6). As a result, the safety device 2 is operated by the remote operation from land.

The safety device 2, in which the control signal is received from the land system 10, is operated based on the control signal (step S7). For example, when a control signal is issued to operate a sprinkler in the event of fire, the control device for the sprinkler (safety device 2) controls the actuator in response to the transmitted control signal and performs an operation to inject fire extinguishing water.

As described above, according to the present embodiment, the safety device 2 can be monitored and controlled even in the land system 10. Therefore, even when the safety device 2 cannot be controlled from the on-ship system 20 for some reason, the safety device 2 can be controlled from the land system 10 to prevent the spread of the disaster. For example, when a video from the television monitoring device (the item number 9 in FIG. 2) is monitored from land and suspicious fire, which is not noticed by the crew member on the ship, or a flame, which cannot be detected by the fire detection alarm device, is noticed, by quickly operating the safety device 2 from land and notifying the crew member on the ship, early detection and early response to disasters becomes possible.

(In Case of On-ship System 20*b*)

Next, with reference to FIG. 3B, monitoring and control of the safety device 2 of the ship 1 provided with the on-ship system 20*b* will be described. FIG. 3B shows an example of an operation in a case where some trouble occurs on the on-ship system 20*b* side. First, the safety device 2 transmits the information related to a disaster detected by the safety device and the information related to an operation state of the safety device to the on-ship system 20*b* (step S11). In parallel, the safety device 2 transmits the information related to the disaster detected by the safety device and the information related to the operation state of the safety device to the communication device 3 (step S12). When the communication device 3 receives the information transmitted from the safety device 2, the communication device 3 transmits the received information to the land system 10 (step S13).

In the on-ship system 20*b*, the on-ship communication unit 25*b* acquires the information transmitted from the safety device 2. The on-ship communication unit 25*b* outputs the acquired information to the control unit 23*b*. The control unit 23*b* outputs the information transmitted from the safety device 2 to the display unit 27*b*. The display unit 27*b* displays the information indicating safety on the ship and the information indicating the operation state of each safety device (step S14). The crew member determines whether or not it is necessary to respond to a disaster while monitoring the information displayed on the display unit 27*b*.

In the land system 10, the control unit 12 acquires the information transmitted by the communication device 3 through the communication unit 14 and outputs the acquired information to the display unit 15. The display unit 15 displays the information indicating safety on the ship and the information indicating the operation state of each safety device (step S14). The monitoring person on land determines whether or not it is necessary to respond to the disaster while monitoring the information displayed on the display unit 15.

When a disaster occurs on the ship, information indicating the occurrence of the disaster is transmitted to the monitoring system 21*b* and the land system 10 by the above process. In the present example, it is assumed that a disaster has occurred. In this case, normally, the crew member determines that it is necessary to respond to the disaster and performs an operation on the safety device 2. The control unit 23*b* generates a control signal to be sent to the safety device 2 based on the operation of the crew member. The control unit 23*b* transmits the control signal to the safety device 2 through the on-ship communication unit 25*b*, and the safety device 2, in which the control signal is received from the on-ship system 20*b*, is operated based on the control signal. These operations are the same as in the case of the on-ship system 20*a* described with reference to FIG. 3A (steps S3 to S4). On the other hand, in the present flowchart, it is assumed that a trouble has occurred such as a shortage of personnel on the ship or a malfunction of the monitoring system 21*b*, which makes it impossible to control the safety device 2 from the on-ship system 20*b* (step S15). In this case, a situation may occur in which the crew member is unable to monitor the display unit 27*b* due to a shortage of personnel or a situation may occur in which a control signal is not generated or transmitted even when the crew member performs an operation on the safety device 2, and thereby a situation occurs in which the safety device 2 is not controlled by the on-ship system 20*b*.

On the other hand, in the land system 10, when the monitoring person determines that it is necessary to respond to a disaster, the monitoring person performs an operation on the safety device 2 that needs to be controlled by using the land system 10. For example, when the crew member call alarm (item number 14 in FIG. 2) is not issued (for example, the monitoring system 21*b* does not function due to malfunction, the crew member is not available, or the like) even though the fire detection alarm device (item number 10 in FIG. 2) is operated, or when the flood detection device (item number 16 in FIG. 2) is not operated even though a video transmitted from the television monitoring device (item number 9 in FIG. 2) shows signs of suspected flooding, the monitoring person on land first determines that it is necessary to inform the crew member on the ship of the occurrence of fire and flooding and performs an instruction of the operation of the crew member call alarm (safety device 2) with respect to the land system 10. Thereafter, the control unit 12 generates a control signal for instructing the issuance of the crew member call alarm and transmits the control signal to the communication device 3 through the communication unit 14 (step S16). The communication device 3 receives the control signal transmitted from the land system 10 and transmits the control signal to the safety device 2 (step S17). The safety device 2, in which the control signal is received from the land system 10, is operated based on the control signal (step S18). In the case of this example, the crew member call alarm is issued.

As described above, according to the on-ship system 20*b* and the land system 10, in addition to the effects obtained by the combination of the on-ship system 20*a* and the land system 10, the safety device 2 can be controlled from the land system 10 regardless of the state of the monitoring system 21*b*.

Even in the combination of the on-ship system 20*a* and the land system 10, unless communication between the land system 10 and the safety device 2 is cut off due to a trouble in the land communication unit 26*a*, it is possible to respond to a disaster by controlling the safety device 2 from the land system 10 in the same manner as the operation described with reference to FIG. 3B even when a trouble occurs on the on-ship system 20*a* side. Needless to say, even with the combination of the on-ship system 20*b* and the land system 10, the same operation as the described with reference to FIG. 3A can be performed.

It is possible to provide priorities in controls for the monitoring system 21 and the land system 10. By providing priorities, it is possible to avoid an operation inconsistency in a case where the monitoring system 21 and the land system 10 output control signals having different instruction contents to the same safety device 2. FIG. 4 shows an example of priorities. (1) An operation mode 1 is a normal priority (initial setting of priority). The highest priority is a control method in which manual control is directly performed on the safety device 2. For example, a button is installed near the fire prevention door, and the fire prevention door opens and closes when the button is pressed. Even in a case where the control is performed to keep the fire prevention door open by using other methods (for example, automatic control or instructions from the safety center), when the crew member presses the button, the fire prevention door can be closed. The next highest priority is control by the monitoring system 21 of the safety center. For example, even in a case where control is performed with the automatic control of the third priority such as keeping the fire prevention door open (for example, automatic control is set to open the fire prevention door in a state in which the fire detection alarm device is not operated), when the monitoring system 21 controls the fire prevention door to close, the fire prevention door can be closed. The lowest priority is the control from the land system 10. In the operation mode 1, only the safety device 2 that is not controlled by other means can be controlled from the land system 10. Even in the operation mode 1, when a control signal is transmitted from the land system 10 and permission and approval for the control signal are input from the monitoring system 21 on the ship, the control signal may be configured to be handled as a control signal having the same second priority as control by the monitoring system 21.

(2) An operation mode 2 is an operation mode in which the land system 10 is given priority. In the operation mode 2, the first priority is "manual", the second priority is "land system", the third priority is "automatic control", and the fourth priority is "on-ship monitoring system". For example, in a case where the ship 1 is labor-saving and the number of crew members is small, the priority of the operation mode 2 may be set. As a result, it is possible to leave the response in the event of a disaster to the land side. Alternatively, even though the operation mode 1 is set and the fire detection alarm device or the flood detection device is operated, and after that, when a situation occurs where the crew member call alarm not is fired even after the predetermined time has elapsed (when an event occurs where t is assumed that the monitoring system 21 is not functioning), the operation mode 1 may be automatically switched to the operation mode 2. As a result, basically, although a system is based on the crew members responding to a disaster at the safety center on the ship, in the event that it is no longer possible to respond to a disaster on the ship due to changes in situation on the ship or a shortage of manpower, it is possible to switch to the land-based control.

(3) An operation mode 3 has the same priority as the operation mode 1 and is an operation mode in which only monitoring is permitted from the land system 10. For example, the operation mode 3 is set in the initial setting, and when the monitoring person on land notices anything during the monitoring, the monitoring person separately contacts the crew member via radio or other means. When there is a shortage of crew members or a situation occurs where monitoring at the safety center is not possible due to the occurrence of a disaster on the ship, the mode may be switched from the operation mode 3 to the operation mode 2 or an operation mode 4, which will be described next, by performing an input for switching the operation mode from the monitoring system 21 or the land system 10.

(4) The operation mode 4 is the same priority setting as the operation mode 2 and is an operation mode in which the monitoring system 21 on the ship is set to be invalid or only monitoring is permitted. For example, in a case where the ship 1 is a labor-saving or unmanned ship, the operation mode 4 may be applied.

The operation mode illustrated in FIG. 4 is an example and is not limited thereto. For example, in the operation modes 1 and 2, the third and fourth priorities may be set in reverse. Considering temporal changes in a disaster situation, even after the operation of a certain safety device 2 is once controlled by high priority means, when the predetermined time has elapsed or a situation has been changed (for example, when the safety device 2, which was not operated at that time after the high priority means output the control signal, detects a disaster and is operated or when the safety device 2 detects information with different levels (for example, when inclination of a hull indicated by a hull posture draft gauge worsens or improves)), even when lower priority means outputs a control signal with different contents to the same safety device 2, the control signal may be configured to be valid. Any priorities may be set for each ship 1. The display unit 15 of the land system 10 may display the operation mode for each ship 1. As a result, when a disaster occurs on a certain ship 1, the monitoring person can understand whether only monitoring needs to be performed while leaving control to the ship basically, or whether the control of the safety device 2 needs to be performed in addition to the monitoring.

Effects

As described above, according to the present embodiment, an environment (land system 10) is constructed on land, which is equivalent to the safety center or the like that enables remote operation and reception of information related to the safety devices 2 collected in the safety center or the control room on the ship, and the information (fire detection, flood detection, watertight door, opening/closing of fire prevention door, operation of fire extinguishing device, or the like) related to the safety device 2 on the ship is transmitted to the land system 10, which is a safety center on land, via the communication device 3 or the land communication unit 26*a*. A monitoring person in charge of monitoring and controlling the system is assigned in the land system 10, and the same work (operation, control, monitoring of the safety devices, or a combination thereof) as at the safety center on the ship is performed on land. When a disaster occurs on the ship 1, a situation on the ship is monitored from the land system 10, and if necessary, the safety device is remotely operated from the land to response to the disastrous situation. As described above, also in the land system 10, which is the safety center on land, by receiving the same information as the monitoring system 21 on the ship, the same monitoring and remote control as the safety center on the ship is possible on the land side. In the land system 10 on land, it is possible to take a calm response without being affected by fire or the inclination caused by flooding. Since the land system 10 can monitor and control the plurality of ships 1 in parallel at the same time, it is possible to contribute to unmanned or labor saving of the ships.

Figure 5:
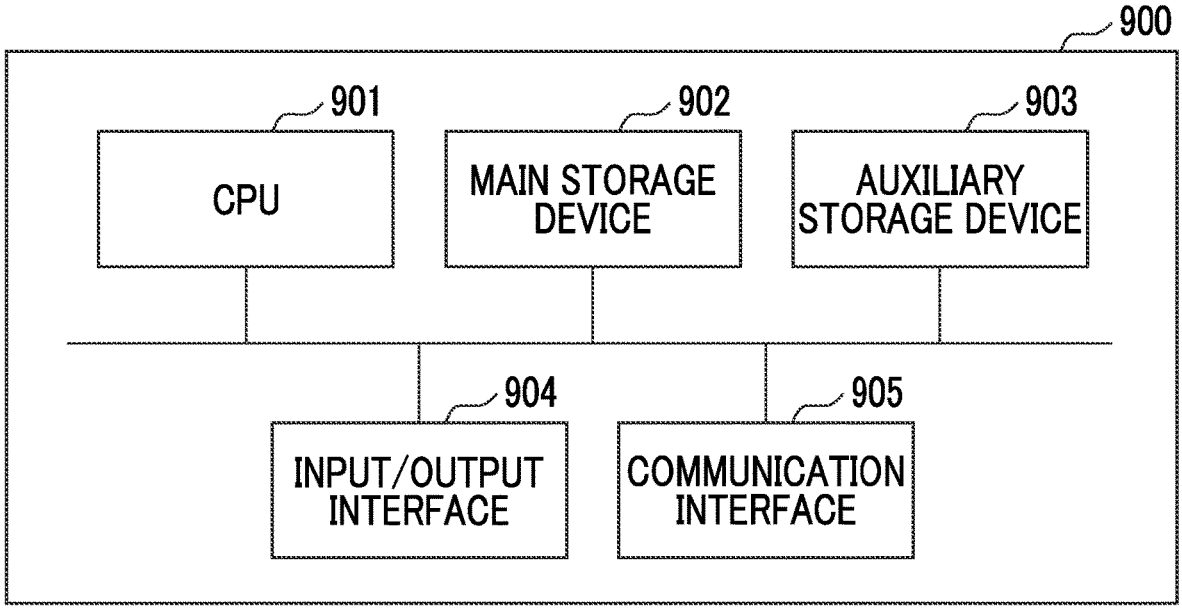
FIG. 5 is a diagram showing an example of a hardware configuration of the safety system according to the embodiment.

FIG. 5 is a diagram showing an example of a hardware configuration of the safety system according to the embodiment.

A computer 900 includes a CPU 901, a main storage device 902, an auxiliary storage device 903, an input/output interface 904, and a communication interface 905.

The land system 10 and the monitoring system 21 described above are mounted on the computer 900. Further, each above-mentioned function is stored in the auxiliary storage device 903 in the form of a program. The CPU 901 reads the program from the auxiliary storage device 903, loads the program into the main storage device 902, and executes the above processes according to the program. The CPU 901 ensures a storage area in the main storage device 902 according to the program. The CPU 901 ensures a storage area for storing the data being processed in the auxiliary storage device 903 according to the program.

A program for implementing all or some of the functions of the land system 10 and the monitoring system 21 may be recorded on a computer-readable recording medium, and the program recorded on the recording medium may be read by a computer system and executed to perform processes by each functional unit. The term "computer system" as used herein includes hardware such as an OS or peripheral devices. The "computer system" is also assumed to include a homepage providing environment (or display environment) when a WWW system is used. The "computer-readable recording medium" refers to a portable medium such as a CD, DVD, or USB, or a storage device such as a hard disk built in the computer system. When this program is distributed to the computer 900 by using a communication line, the computer 900, which has received the distribution of the program, may load the program into the main storage device 902 and execute the above processes. The above-mentioned program may be a program for implementing some of the above-mentioned functions and further implementing the above-mentioned functions in combination with a program already recorded in the computer system.

As described above, some embodiments according to the present disclosure have been described, but all of these embodiments are presented as examples and are not intended to limit the scope of the invention. These embodiments can be implemented in various other forms, and various omissions, replacements, and changes can be made without departing from the gist of the invention. These embodiments and variations thereof are included in the scope of the invention described in the claims and the equivalent scope thereof, as well as in the scope and gist of the invention.

Additional Notes

The safety system, the land system, the on-ship system, and the control method described in each embodiment are ascertained as follows, for example.

(1) A safety system 100 according to a first aspect includes: an on-ship system (20*a*, 20*b*) that is provided on a ship and that includes a safety detection device (for example, sensors such as the item numbers 7 to 10, 16, and 18 among the safety devices 2 illustrated in FIG. 2) and a safety maintenance device (for example, the remaining items among the safety devices 2 illustrated in FIG. 2) that are provided on the ship, a first acquisition unit (on-ship communication unit 25*a*, 25*b*) that acquires information (presence or absence of fire/flooding or the like) detected by the safety detection device and information indicating a state (whether or not it is in operation) of the safety maintenance device, a first control unit (23*a*, 23*b*) controls the safety that maintenance device, and a communication unit (land communication unit 26*a*, communication device 3) that communicates with the land system; and a land system that is provided on land and that includes a second acquisition unit (communication unit 14) that acquires the information detected by the safety detection device and the information indicating the state of the safety maintenance device through the communication unit, and a second control unit that outputs a control signal for controlling the safety maintenance device to the safety maintenance device through the communication unit.

As a result, the safety device 2 can be monitored and controlled not only from the on-ship system 20 but also from the land system 10.

(2) In the safety system 100 of a second aspect according to the safety system of (1), the on-ship system 20 and the land system 10 acquire the information detected by the same safety detection device and the information indicating the state of the same safety maintenance device.

As a result, even in the land system 10, the same information as in the ship can be obtained and the situation on the ship can be monitored.

(3) In the safety system 100 of a third aspect according to the safety system of (1) or (2), after the first control unit outputs a control signal to one of the safety maintenance devices, even when the second control unit outputs a control signal to the corresponding safety maintenance device, the control signal is set to be invalid (operation mode 1 in FIG. 4).

As a result, even when different control signals are instructed to the same safety device 2, the safety device 2 can be controlled without any inconsistency.

(4) In the safety system 100 of a fourth aspect according to the safety system of (3), after the first control unit outputs the control signal to one of the safety maintenance devices, when predetermined time elapses or the information detected by the safety detection device is changed, the control signal output to the corresponding safety maintenance device by the second control unit is set to be valid.

As a result, when appropriate control is not performed from the on-ship system 20 to the safety device 2 even in a case where the disaster situation is changed, the corresponding safety device 2 can be controlled from the land system 10.

(5) In the safety system 100 of a fifth aspect according to the safety system of (1) or (2), after the second control unit outputs a control signal to one of the safety maintenance devices, even when the first control unit outputs a control signal to the corresponding safety maintenance device, the control signal is set to be invalid (operation mode 2 in FIG. 4).

For example, by setting a labor-saving ship in the operation mode 2, the crew member on the ship can leave the response to the land side in the event of a disaster.

(6) In the safety system 100 of a sixth aspect according to the safety system of (1) or (2), a first operation mode in which, after the first control unit outputs a control signal to one of the safety maintenance devices, even when the second control unit outputs a control signal to the corresponding safety maintenance device, the control signal is set to be invalid, and a second operation mode in which, after the second control unit outputs a control signal to one of the safety maintenance devices, even when the first control unit outputs a control signal to the corresponding safety maintenance device, the control signal is set to be invalid, can be set in a switchable manner.

As a result, basically, although a system is based on the crew members responding to a disaster at the safety center on the ship, in the event that it is no longer possible to respond to a disaster on the ship due to changes in situation on the ship or a lack of manpower, it is possible to switch to the land-based control.

(7) A land system according to a seventh aspect includes: a communication unit that communicates with a safety detection device and a safety maintenance device, which are provided on a ship, through a communication device provided on the ship; an acquisition unit that acquires information detected by the safety detection device and information indicating a state of the safety maintenance device through the communication unit; and a control unit that outputs a control signal for controlling the safety maintenance device to the safety maintenance device through the communication unit.

As a result, it is possible to monitor the safety detection device and the safety maintenance device on the ship from the land system and control the safety maintenance device.

(8) An on-ship system according to an eighth aspect includes: a safety detection device and a safety maintenance device that are provided on a ship; an acquisition unit that acquires information detected by the safety detection device and information indicating a state of the safety maintenance device; a control unit that controls the safety maintenance device; and a communication unit that transmits the information detected by the safety detection device and the information indicating the state of the safety maintenance device to a land system and receives a control signal for controlling the safety maintenance device from the land system.

As a result, it is possible to implement a land system in which similar functions are mirrored on the land side while maintaining the functions to execute, on the ship, monitoring the safety detection device and safety maintenance device, which are generally provided on the ship, and controlling the safety maintenance device.

(9) A control method according to a ninth aspect is a control method of a safety detection device and a safety maintenance device provided on a ship, the control method includes: step of acquiring, by an on-ship system provided on the ship, information detected by the safety detection device and information indicating a state of the safety maintenance device; a step of transmitting, by the on-ship system, the information acquired in the step of acquiring to a land system provided on land; a step of acquiring, by the land system, the information transmitted in the step of transmitting; and a step of transmitting, by the land system, a control signal for controlling the safety maintenance device to the safety maintenance device.

INDUSTRIAL APPLICABILITY

According to the safety system, the land system, the on-ship system, and the control method described above, monitoring related to ship safety and control of a safety device, which can generally only be performed on a ship, can be performed on land as well as on a ship.

REFERENCE SIGNS LIST

1 ship
2 safety device
3 communication device
10 land system
11 input unit
12 control unit
13 storage unit
14 communication unit
15 display unit
20, 20*a*, 20*b* on-ship system
21, 21*a*, 21*b* monitoring system
22*a*, 22*b* input unit
23*a*, 23*b* control unit
24*a*, 24*b* storage unit
25*a*, 25*b* on-ship communication unit
26*a* land communication unit
27*a*, 27*b* display unit
100 safety system
900 computer
901 CPU
902 main storage device
903 auxiliary storage device
904 input/output interface
905 communication interface

The invention claimed is:

1. A safety system comprising:

an on-ship system that is provided on a ship; and a land system that is provided on land, wherein the on-ship system includes a safety detection device and a safety maintenance device for preventing disasters occurring in the ship, that are provided on the ship, a first acquisition unit that acquires information detected by the safety detection device and information indicating an operation state of the safety maintenance device, a first control unit that controls an actuator included in the safety maintenance device, and a communication unit that communicates with the land system, and the land system includes a second acquisition unit that acquires the information detected by the safety detection device and the information indicating the operation state of the safety maintenance device through the communication unit, and a second control unit that outputs a control signal for controlling the safety maintenance device to the safety maintenance device through the communication unit, wherein after the first control unit outputs a control signal to one of the safety maintenance devices, even when the second control unit outputs a control signal to the corresponding safety maintenance device, the control signal is set to be invalid.

2. The safety system according to claim 1, wherein the on-ship system and the land system acquire the information detected by the same safety detection device and the information indicating the operation state of the same safety maintenance device.

3. The safety system according to claim 1, wherein after the second control unit outputs a control signal to one of the safety maintenance devices, even when the first control unit outputs a control signal to the corresponding safety maintenance device, the control signal is set to be invalid.

4. The safety system according to claim 1, wherein the safety maintenance device includes at least one of a power type ventilation device, a fire prevention door, a watertight door and semi-watertight door, a fixed local fire extinguishing device, a sprinkler, a fire extinguishing device, a smoke evacuation device, and a fire pump.

5. The safety system according to claim 1, wherein a first operation mode and a second operation mode can be set in a switchable manner, wherein the first operation mode is that, after the first control unit outputs a control signal to one of the safety maintenance devices, even when the second control unit outputs a control signal to the corresponding safety maintenance device, the control signal is set to be invalid, and wherein the second operation mode is that, after the second control unit outputs a control signal to one of the safety maintenance devices, even when the first control unit outputs a control signal to the corresponding safety maintenance device, the control signal is set to be invalid.

6. A safety system comprising:

an on-ship system that is provided on a ship; and a land system that is provided on land, wherein the on-ship system includes a safety detection device and a safety maintenance device for preventing disasters occurring in the ship, that are provided on the ship, a first acquisition unit that acquires information detected by the safety detection device and information indicating an operation state of the safety maintenance device, a first control unit that controls an actuator included in the safety maintenance device, and a communication unit that communicates with the land system, and the land system includes a second acquisition unit that acquires the information detected by the safety detection device and the information indicating the operation state of the safety maintenance device through the communication unit, and a second control unit that outputs a control signal for controlling the safety maintenance device to the safety maintenance device through the communication unit, wherein after the first control unit outputs a control signal to one of the safety maintenance devices, when predetermined time elapses or the information detected by the safety detection device is changed, the control signal output to the corresponding safety maintenance device by the second control unit is set to be valid.

7. A control method of a safety maintenance device provided on a ship, the control method comprising:

a step of acquiring, by an on-ship system provided on the ship, information detected by a safety detection device for preventing disasters occurring in the ship provided on the ship and information indicating an operation state of the safety maintenance device;

a step of transmitting, by the on-ship system, the information acquired in the step of acquiring to a land system provided on land;

a step of acquiring, by the land system, the information transmitted in the step of transmitting; and a step of transmitting, by the land system, a control signal for controlling an actuator included in the safety maintenance device to the safety maintenance device, wherein after a control unit, which is included in the on-ship system and controls the safety maintenance devices, outputs a control signal to one of the safety maintenance devices, even when the land system outputs a control signal to the corresponding safety maintenance device, the control signal is set to be invalid.

* * * * *